US011130336B2

(12) United States Patent
Kakamu et al.

(10) Patent No.: US 11,130,336 B2
(45) **Date of Patent: *Sep. 28, 2021**

(54) LIQUID EJECTION HEAD

(71) Applicant: BROTHER KOGYO KABUSHIKI KAISHA, Nagoya (JP)

(72) Inventors: Katsumi Kakamu, Kuwana (JP); Masaaki Deguchi, Chiryu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/527,129

(22) Filed: Jul. 31, 2019

(65) Prior Publication Data

US 2020/0039221 A1 Feb. 6, 2020

(30) Foreign Application Priority Data

Aug. 6, 2018 (JP) ..... JP2018-147776

(51) Int. Cl.
*B41J 2/14* (2006.01)
*B41J 2/055* (2006.01)

(52) U.S. Cl.
CPC ..... *B41J 2/1433* (2013.01); *B41J 2/055* (2013.01); *B41J 2/14201* (2013.01); *B41J 2002/14241* (2013.01); *B41J 2002/14491* (2013.01)

(58) Field of Classification Search
CPC ..... B41J 2/055; B41J 2/14201; B41J 2/1433
See application file for complete search history.

(56) References Cited

U.S. PATENT DOCUMENTS 10,864,915 B2 * 12/2020 Fujiki ..... B62D 15/0255

FOREIGN PATENT DOCUMENTS

| | | | |
|---|---|---|---|
| JP | 2016-030367 | A | 3/2016 |
| JP | 2017-113932 | A | 6/2017 |
| JP | 2018-051889 | A | 4/2018 |

* cited by examiner

*Primary Examiner* — Lamson D Nguyen
(74) *Attorney, Agent, or Firm* — Scully, Scott, Murphy & Presser, PC

(57) ABSTRACT

A liquid ejection head includes: a plurality of individual passages each having a nozzle; a first supply liquid passage communicating with a first inlet of each of the plurality of individual passages; a second supply liquid passage communicating with a second inlet of each of the plurality of individual passages; a first return liquid passage communicating with a first outlet of each of the plurality of individual passages; and a second return liquid passage communicating with a second outlet of each of the plurality of individual passages.

19 Claims, 10 Drawing Sheets

LIQUID EJECTION HEAD

CROSS REFERENCE TO RELATED APPLICATION

The present application claims priority from Japanese Patent Application No. 2018-147776, which was filed on Aug. 6, 2018, the disclosure of which is herein incorporated by reference in its entirety.

BACKGROUND

The following disclosure relates to a liquid ejection head including a plurality of individual passages each having a nozzle.

There is known a liquid ejection head including: second common liquid passages (supply liquid passages) each communicating with inlets of corresponding ones of a plurality of individual passages; and first common liquid passages (return liquid passages) each communicating with outlets of corresponding ones of the plurality of individual passages. Liquid is supplied to the second common liquid passages through their respective one ends. While flowing from the one end to the other end of each of the second common liquid passages, the liquid enters into the inlets of the respective individual passages communicating with the second common liquid passage. The liquid having flowed into each of the individual passages is partly ejected from a nozzle. The remaining portion of the liquid flows into a corresponding one of the first common liquid passages via the outlet of the individual passage. The liquid having flowed into the first common liquid passage flows from one end toward the other end of the first common liquid passage and is collected from the other end of the first common liquid passage.

SUMMARY

In the above-described liquid ejection head, each of the individual passages has one inlet and one outlet. One of the second common liquid passages (the supply liquid passages) is connected to the one inlet, and one of the first common liquid passages (the return liquid passages) is connected to the one outlet. In this configuration, the speed of ink flow easily lowers particularly at corner portions of the individual passage, which may lead to insufficient discharging of air bubbles and insufficient stirring of settling components (components of liquid with a possibility of settling, such as pigments).

Accordingly, an aspect of the disclosure relates to a liquid ejection head capable of reducing lowering of the speed of ink flow in each of individual passages and reducing insufficient discharging of air bubbles and insufficient stirring of settling components.

In one aspect of the disclosure, a liquid ejection head includes: a plurality of individual passages each having a nozzle; a first supply liquid passage communicating with a first inlet of each of the plurality of individual passages; a second supply liquid passage communicating with a second inlet of each of the plurality of individual passages; a first return liquid passage communicating with a first outlet of each of the plurality of individual passages; and a second return liquid passage communicating with a second outlet of each of the plurality of individual passages.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which.

EMBODIMENTS

First Embodiment

Figure 1:
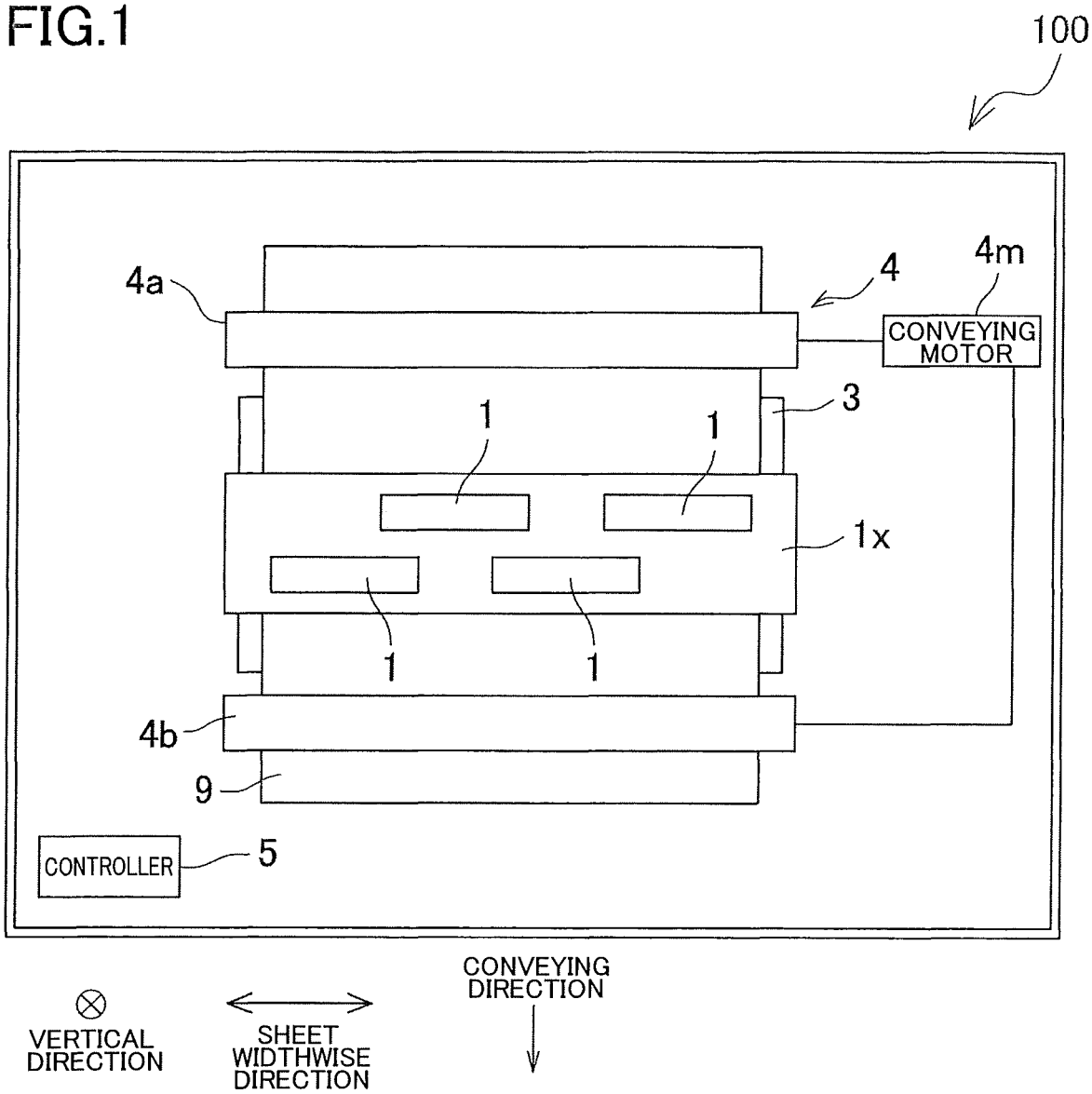
FIG. 1 is a plan view of a printer including heads according to a first embodiment.

Hereinafter, there will be described embodiments by reference to the drawings. First, there will be described, with reference to FIG. 1, an overall configuration of a printer 100 including heads 1 according to a first embodiment.

The printer 100 includes a head unit 1*x*, a platen 3, a conveying mechanism 4, and a controller 5. The head unit 1*x* includes the four heads 1.

An upper surface of the platen 3 is capable of supporting a sheet 9.

The conveying mechanism 4 includes two roller pairs 4*a*, 4*b*. The platen 3 is interposed between the roller pairs 4*a*, 4*b* in a conveying direction. When a conveying motor 4*m* is driven by the controller 5, the roller pairs 4*a*, 4*b* are rotated in a state in which the sheet 9 is nipped by the roller pairs 4*a*, 4*b*, whereby the sheet 9 is conveyed in the conveying direction.

The head unit 1*x* is of a line type and elongated in a widthwise direction of the sheet 9. The line type is a type in which the head unit 1*x* ejects ink onto the sheet 9 from nozzles 21 (see FIGS. 2-4), with the position of the head unit 1*x* being fixed. The four heads 1 are arranged in the widthwise direction of the sheet 9 in a staggered configuration.

The controller 5 includes a read-only memory (ROM), a random-access memory (RAM), and an application-specific integrated circuit (ASIC). The ASIC executes various processings, such as a recording processing, according to programs stored in the ROM. In the recording processing, the controller 5 controls the conveying motor 4*m* and a driver IC 1*d* of the head 1 (see FIGS. 4 and 5) to record an image on the sheet 9, based on a recording command (containing image data) input from an external device such as a personal computer (PC).

Figure 2:
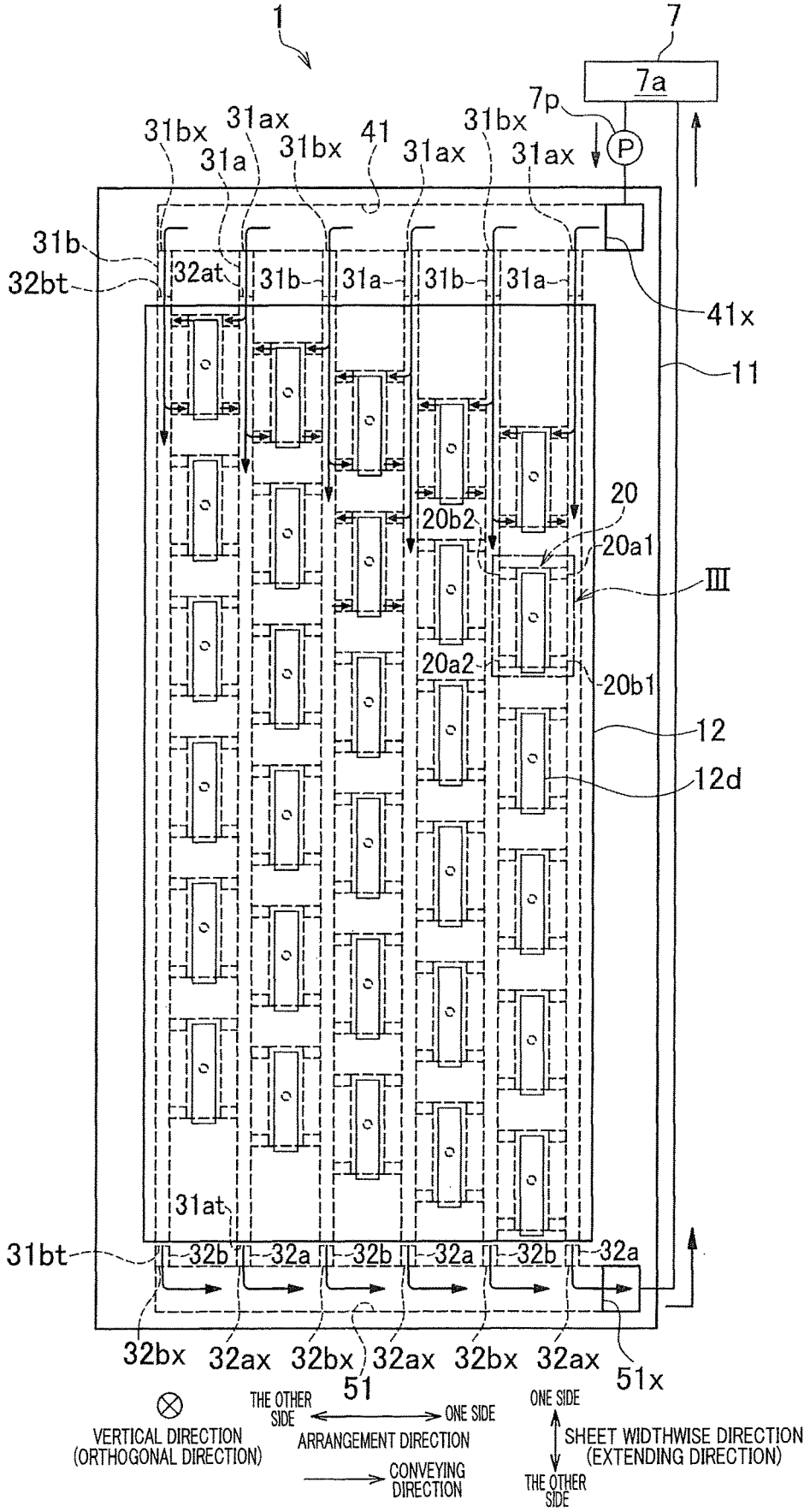
FIG. 2 is a plan view of the head.
Figure 3:
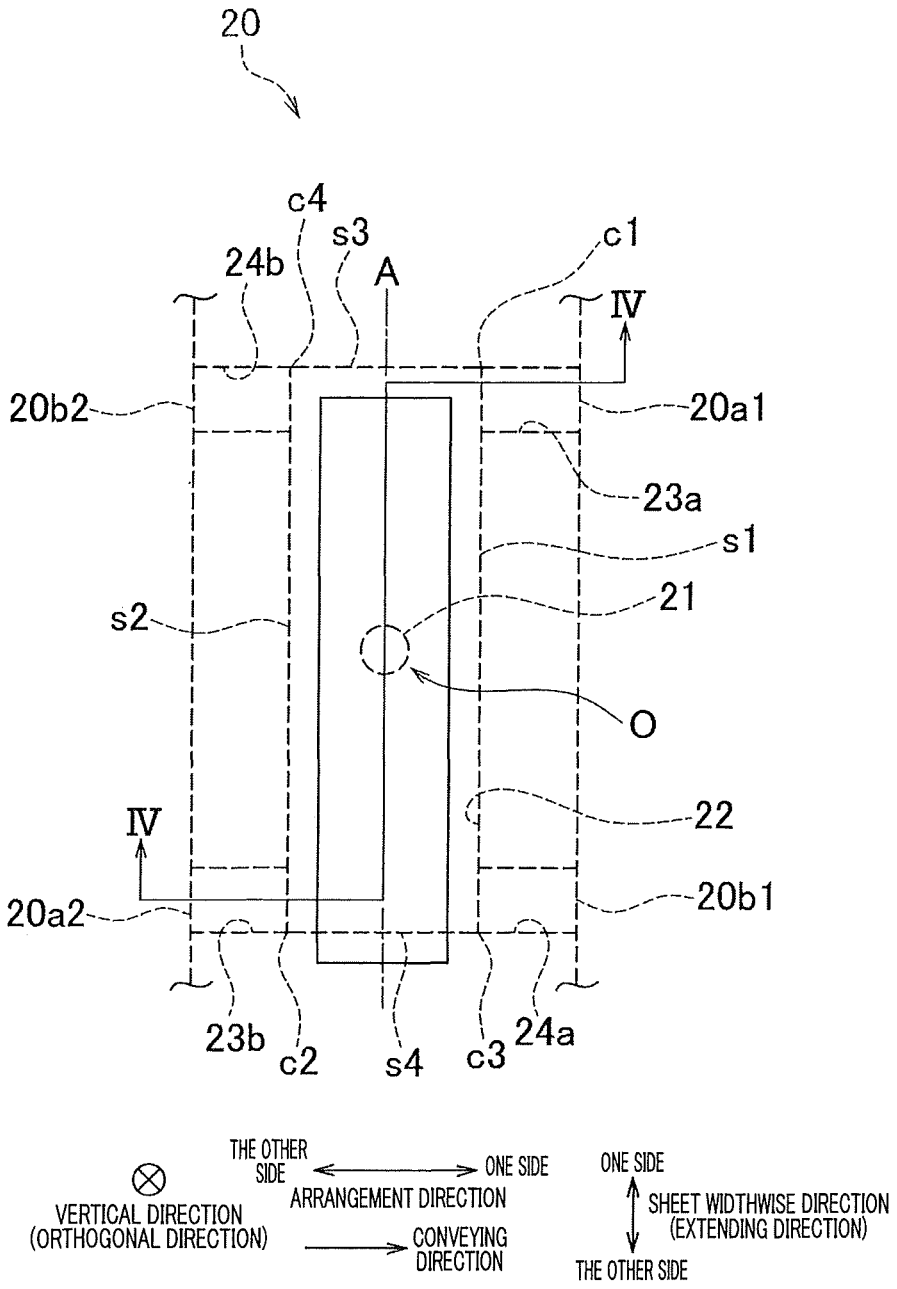
FIG. 3 is an enlarged view of a region III in FIG. 2.
Figure 4:
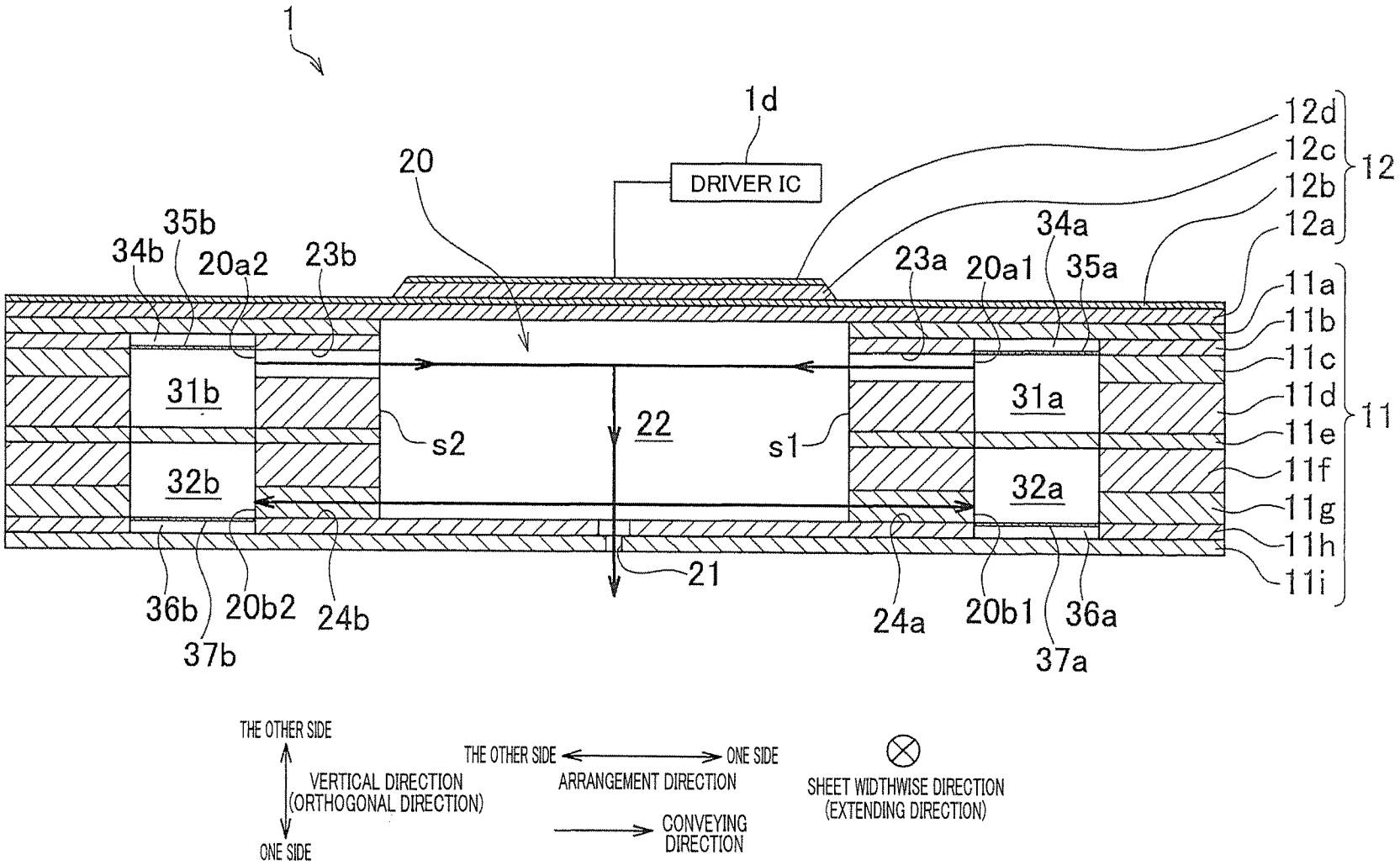
FIG. 4 is a cross-sectional view taken along line IV-IV in FIG. 3.
Figure 5:
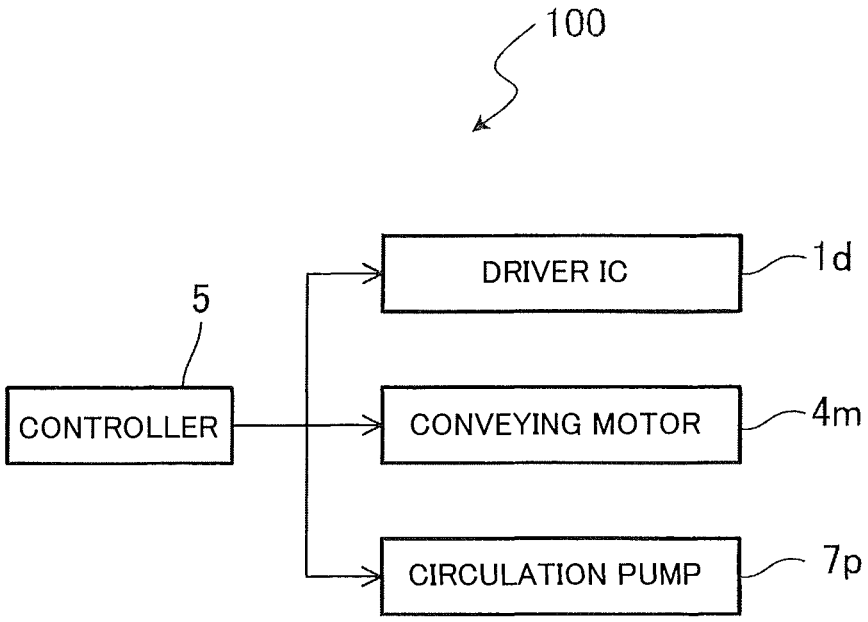
FIG. 5 is a block diagram illustrating an electric configuration of the printer.

There will be next described a configuration of each of the heads 1 with reference to FIGS. 2-4. Since the heads 1 have the same configuration, the configuration of one of the heads 1 will be described for simplicity.

The head 1 includes a liquid-passage defining plate 11 and an actuator unit 12.

As illustrated in FIG. 4, the liquid-passage defining plate 11 includes nine plates 11*a*-11*i* stacked on and bonded to each other. Each of the plates 11a-11i has through holes constituting liquid passages and openings formed in the liquid-passage defining plate 11.

As illustrated in FIG. 2, passages formed in the liquid-passage defining plate 11 include: a plurality of individual passages 20; a plurality of first supply liquid passages 31a communicating with first inlets 20a1 of the respective individual passages 20; a plurality of second supply liquid passages 31b communicating with second inlets 20a2 of the respective individual passages 20; a plurality of first return liquid passages 32a communicating with first outlets 20b1 of the respective individual passages 20; a plurality of second return liquid passages 32b communicating with second outlets 20b2 of the respective individual passages 20; a supply coupling liquid passage 41 coupling the supply liquid passages 31a, 31b to each other; and a return coupling liquid passage 51 coupling the return liquid passages 32a, 32b to each other.

The supply liquid passages 31a, 31b and the return liquid passages 32a, 32b extend in the same direction that coincides with the widthwise direction of the sheet 9 and may be hereinafter referred to as "extending direction". The supply liquid passages 31a, 31b and the return liquid passages 32a, 32b are arranged in a direction along the conveying direction which may be hereinafter referred to as "arrangement direction". In the present embodiment, the arrangement direction is orthogonal to the extending direction.

As illustrated in FIG. 4, the first supply liquid passages 31a and the respective first return liquid passages 32a overlap each other in the vertical direction (that is orthogonal to each of the extending direction and the arrangement direction and hereinafter may be referred to as "orthogonal direction"). The second supply liquid passages 31b and the respective second return liquid passages 32b overlap each other in the vertical direction. The first supply liquid passages 31a and the second supply liquid passages 31b are located at the same position in the orthogonal direction and located respectively over the first return liquid passages 32a and the second return liquid passages 32b in the vertical direction. In other words, the first supply liquid passages 31a and the second supply liquid passages 31b are located on the other side respectively of the first return liquid passages 32a and the second return liquid passages 32b in the orthogonal direction. The first return liquid passages 32a and the second return liquid passages 32b are located at the same position in the orthogonal direction and located respectively over the first supply liquid passages 31a and the second supply liquid passages 31b in the vertical direction. In other words, first return liquid passages 32a and the second return liquid passages 32b are located on one side respectively of the first supply liquid passages 31a and the second supply liquid passages 31b in the orthogonal direction.

As illustrated in FIG. 2, the first supply liquid passages 31a (the corresponding first return liquid passages 32a) and the second supply liquid passages 31b (the corresponding second return liquid passages 32b) are alternately arranged in the arrangement direction.

Each of the first supply liquid passages 31a communicates with the supply coupling liquid passage 41 via an inlet 31ax formed at a one-side end portion of the first supply liquid passage 31a in the extending direction. Each of the second supply liquid passages 31b communicates with the supply coupling liquid passage 41 via an inlet 31bx formed at a one-side end portion of the second supply liquid passage 31b in the extending direction. A distal end 31at of each of the first supply liquid passages 31a in the extending direction and a distal end 31bt of each of the second supply liquid passages 31b in the extending direction are closed and located on the other side of corresponding ones of the plurality of individual passages 20 in the extending direction.

Each of the first return liquid passages 32a communicates with the return coupling liquid passage 51 via an outlet 32ax formed at an other-side end portion of the first return liquid passage 32a in the extending direction. Each of the second return liquid passages 32b communicates with the return coupling liquid passage 51 via an outlet 32bx formed at an other-side end portion of the second return liquid passage 32b in the extending direction. A distal end 32at of each of the first return liquid passages 32a in the extending direction and a distal end 32bt of each of the second return liquid passages 32b in the extending direction are closed and located on one side of corresponding ones of the plurality of individual passages 20 in the extending direction.

Each of the supply coupling liquid passage 41 and the return coupling liquid passage 51 extends in the arrangement direction. The supply coupling liquid passage 41 is located on the one side of the supply liquid passages 31a, 31b and the return liquid passages 32a, 32b in the extending direction. The return coupling liquid passage 51 is located on the other side of the supply liquid passages 31a, 31b and the return liquid passages 32a, 32b in the extending direction. The supply coupling liquid passage 41 and the return coupling liquid passage 51 are arranged so as to be symmetric with respect to a plane extending along the arrangement direction and the orthogonal direction through the center of the liquid-passage defining plate 11 in the extending direction.

The supply coupling liquid passage 41 communicates at its other-side surface in the extending direction with the inlets 31ax of the respective first supply liquid passages 31a and the inlets 31bx of the respective second supply liquid passages 31b. The return coupling liquid passage 51 communicates at its one-side surface in the extending direction with the outlets 32ax of the respective first return liquid passages 32a and the outlets 32bx of the respective second return liquid passages 32b.

The supply coupling liquid passage 41 communicates with a storage chamber 7a of a sub-tank 7 via a supply opening 41x. The supply opening 41x is formed at a one-side end portion of the supply coupling liquid passage 41 in the arrangement direction and is located on one side of coupled portions of the respective supply liquid passages 31a, 31b (the inlets 31ax, 31bx of the respective supply liquid passages 31a, 31b) in the arrangement direction.

The return coupling liquid passage 51 communicates with the storage chamber 7a via a return opening 51x. The return opening 51x is formed at a one-side end portion of the return coupling liquid passage 51 in the arrangement direction and is located on the one side of coupled portions of the respective return liquid passages 32a, 32b (the outlets 32ax, 32bx of the respective return liquid passages 32a, 32b) in the arrangement direction.

The sub-tank 7 is installed in the head 1. The storage chamber 7a communicates with a main tank, not illustrated, for storing the ink and stores the ink supplied from the main tank.

The individual passages 20 are arranged between the supply coupling liquid passage 41 and the return coupling liquid passage 51 in the extending direction. Each of the individual passages 20 is disposed between a corresponding one of the inlets 31ax, 31bx of the respective supply liquid passages 31a, 31b and a corresponding one of the outlets 32ax, 32bx of the respective return liquid passages 32a, 32b.

Each of the individual passages 20 is disposed in the arrangement direction between a corresponding pair of the first supply liquid passage 31*a* and the first return liquid passage 32*a* adjacent to each other and a corresponding pair of the second supply liquid passage 31*b* and the second return liquid passage 32*b* adjacent to each other.

The individual passages 20 are arranged in five rows, in each of which the individual passages 20 each extending in the extending direction are arranged in the extending direction. The five rows are arranged in the arrangement direction. A pair of the first supply liquid passage 31*a* and the first return liquid passage 32*a* and a pair of the second supply liquid passage 31*b* and the second return liquid passage 32*b* are formed on opposite sides of each of the rows of the individual passages 20 in the arrangement direction. In the present embodiment, the pair of the first supply liquid passage 31*a* and the first return liquid passage 32*a* or the pair of the second supply liquid passage 31*b* and the second return liquid passage 32*b* formed between two of the rows of the individual passages 20 which are adjacent to each other in the arrangement direction communicate with the individual passages 20 belonging to the two rows.

As illustrated in FIGS. 3 and 4, each of the individual passages 20 includes: a nozzle 21; a pressure chamber 22 communicating with the nozzle 21; a first inflow passage 23*a* connecting between the pressure chamber 22 and the first inlets 20*a*1; a second inflow passage 23*b* connecting between the pressure chamber 22 and the second inlets 20*a*2; a first outflow passage 24*a* connecting between the pressure chamber 22 and the first outlets 20*b*1; and a second outflow passage 24*b* connecting between the pressure chamber 22 and the second outlets 20*b*2. As illustrated in FIG. 3, the pressure chamber 22 is of a rectangular shape extending in the extending direction on the plane extending along the extending direction and the arrangement direction. The pressure chamber 22 has four corner portions c1-c4 and four sides s1-s4. The nozzle 21 is located just under the pressure chamber 22 at a center point O of the pressure chamber 22 on the plane.

Each of the first inflow passage 23*a* and the first outflow passage 24*a* extends in the arrangement direction from the side s1 of the pressure chamber 22 which extends in the extending direction. Each of the second inflow passage 23*b* and the second outflow passage 24*b* extends in the arrangement direction from the side s2 of the pressure chamber 22 which extends in the extending direction and is opposed to the side s1 in the arrangement direction.

The first inflow passage 23*a* and the second inflow passage 23*b* are connected to the respective corner portions c1, c2 of the pressure chamber 22, which are symmetric with respect to the center point O. The first inflow passage 23*a* and the second inflow passage 23*b* are arranged so as to be symmetric with respect to the center point O. Likewise, the first inlet 20*a*1 and the second inlet 20*a*2 are arranged so as to be symmetric with respect to the center point O.

The first outflow passage 24*a* and the second outflow passage 24*b* are connected to the respective corner portions c3, c4 of the pressure chamber 22, which are symmetric with respect to the center point O. The first outflow passage 24*a* and the second outflow passage 24*b* are arranged so as to be symmetric with respect to the center point O. Likewise, the first outlets 20*b*1 and the second outlets 20*b*2 are arranged so as to be symmetric with respect to the center point O.

The first inflow passage 23*a* and the second outflow passage 24*b* are arranged so as to be symmetric with respect to the axis A extending along the extending direction through the center of the pressure chamber 22 in the arrangement direction. The second inflow passage 23*b* and the first outflow passage 24*a* are arranged so as to be symmetric with respect to the axis A extending along the extending direction through the center of the pressure chamber 22 in the arrangement direction.

As illustrated in FIG. 4, the first outflow passage 24*a* and the second outflow passage 24*b* are located respectively under the first inflow passage 23*a* and the second inflow passage 23*b* in the vertical direction. In other words, the first outflow passage 24*a* and the second outflow passage 24*b* are located respectively on the one side of the first inflow passage 23*a* and the second inflow passage 23*b* in the orthogonal direction.

The nozzle 21 is constituted by through holes formed in the respective plates 11*h*, 11*i*. The pressure chamber 22 is constituted by through holes formed in the respective plates 11*a*-11*g*. Each of the first inflow passage 23*a* and the second inflow passage 23*b* is constituted by a through hole formed in the plate 11*c*. Each of the first outflow passage 24*a* and the second outflow passage 24*b* is constituted by a through hole formed in the plate 11*g*. The nozzle 21 is located at a lower end portion of each of the individual passages 20 in the vertical direction (a one-side end portion of each of the individual passages 20 in the orthogonal direction).

Each of the supply liquid passages 31*a*, 31*b* is constituted by through holes formed in the respective plates 11*c*, 11*d*. Each of the return liquid passages 32*a*, 32*b* is constituted by through holes formed in the respective plates 11*f*, 11*g*.

Damper films 35*a*, 35*b*, 37*a*, 37*b* are provided respectively in the supply liquid passages 31*a*, 31*b* and the return liquid passages 32*a*, 32*b*. The damper films 35*a*, 35*b* define upper surfaces of the respective supply liquid passages 31*a*, 31*b*. The damper films 37*a*, 37*b* define lower surfaces of the respective return liquid passages 32*a*, 32*b*. Specifically, the plate 11*b* has: through holes respectively serving as damper chambers 34*a*, 34*b* at regions located over the respective supply liquid passages 31*a*, 31*b*. The damper films 35*a*, 35*b* are mounted on a lower surface of the plate 11*b* so as to cover the respective damper chambers 34*a*, 34*b*. The plate 11*h* has: through holes respectively serving as damper chambers 36*a*, 36*b* at regions located under the respective return liquid passages 32*a*, 32*b*. The damper films 37*a*, 37*b* are mounted on an upper surface of the plate 11*h* so as to cover the respective damper chambers 36*a*, 36*b*.

Each of the damper films 35*a*, 35*b*, 37*a*, 37*b* is a film-like member with a thickness that is less than that of each of the plates 11*a*-11*i*.

Here, there will be described the flow of ink in the liquid-passage defining plate 11. The arrows in FIGS. 2 and 4 indicate the flows of the ink.

As illustrated in FIG. 2, when the controller 5 drives a circulation pump 7*p*, the ink in the storage chamber 7*a* is supplied from the supply opening 41*x* to the supply coupling liquid passage 41. The ink supplied to the supply coupling liquid passage 41 flows in the supply coupling liquid passage 41 from the one side toward the other side in the arrangement direction and enters into the inlets 31*ax*, 31*bx* of the respective supply liquid passages 31*a*, 31*b*. The ink having flowed in the inlets 31*ax* of the respective first supply liquid passages 31*a* flows in the first supply liquid passages 31*a* from the one side toward the other side in the extending direction and enters into the first inlets 20*a*1 of the respective individual passages 20. The ink having flowed in the inlets 31*bx* of the respective second supply liquid passages 31*b* flows in the second supply liquid passages 31*b* from the one side toward the other side in the extending direction and enters into the second inlets 20*a*2 of the respective individual passages 20.

In each of the individual passages 20, as illustrated in FIG. 4, the ink having flowed from the first supply liquid passage 31*a* to the first inlet 20*a*1 enters into the pressure chamber 22 through the first inflow passage 23*a*. In each of the individual passages 20, the ink having flowed from the second supply liquid passage 31*b* to the second inlet 20*a*2 enters into the pressure chamber 22 through the second inflow passage 23*b*. A portion of the ink having entered into the pressure chamber 22 is ejected from the nozzle 21 while the remaining ink flows from the first outlet 20*b*1 to the first return liquid passage 32*a* through the first outflow passage 24*a* and from the second outlet 20*b*2 to the second return liquid passage 32*b* through the second outflow passage 24*b*.

As illustrated in FIG. 2, the ink having flowed in the first return liquid passage 32*a* flows in the first return liquid passage 32*a* from the one side toward the other side in the extending direction and enters from the outlet 32*ax* into the return coupling liquid passage 51. The ink having flowed in the second return liquid passage 32*b* flows in the second return liquid passage 32*b* from the one side toward the other side in the extending direction and enters from the outlet 32*bx* into the return coupling liquid passage 51. The ink having flowed in the return coupling liquid passage 51 flows in the return coupling liquid passage 51 from the other side toward the one side in the arrangement direction and enters from the return opening 51*x* back into the storage chamber 7*a*.

This circulation of the ink between the storage chamber 7*a* and each of the individual passages 20 enables discharge of air bubbles from the individual passages 20 and prevents increase in viscosity of the ink. Furthermore, in the case where the ink contains settling components (components with a possibility of settling, such as pigments), the components are stirred, thereby preventing settling of the components.

The actuator unit 12 is disposed on an upper surface of the liquid-passage defining plate 11 so as to cover the pressure chambers 22.

As illustrated in FIG. 4, the actuator unit 12 includes a vibration plate 12*a*, a common electrode 12*b*, a plurality of piezoelectric elements 12*c*, and a plurality of individual electrodes 12*d* stacked in order from below. The vibration plate 12*a* and the common electrode 12*b* cover the pressure chambers 22. Each of the piezoelectric elements 12*c* and each of the individual electrodes 12*d* are provided for a corresponding one of the pressure chambers 22 so as to be opposed to the corresponding pressure chamber 22 in the orthogonal direction.

The individual electrodes 12*d* and the common electrode 12*b* are electrically connected to the driver IC 1*d*. The driver IC 1*d* keeps the electric potential of the common electrode 12*b* at the ground potential and changes the electric potential of each of the individual electrodes 12*d*. Specifically, the driver IC 1*d* creates drive signals based on control signals output from the controller 5 and transmits the drive signals to the individual electrodes 12*d*. As a result, the electric potential of each of the individual electrodes 12*d* is changed between a predetermined driving potential and the ground potential. In this operation, for each of the piezoelectric elements 12*c*, portions of the vibration plate 12*a* and the piezoelectric element 12*c* which are located between a corresponding one of the individual electrodes 12*d* and a corresponding one of the pressure chambers 22 are deformed so as to protrude toward the pressure chamber 22. This changes the volume of the pressure chamber 22, so that a pressure is applied to the ink in the pressure chamber 22 to eject the ink from a corresponding one of the nozzles 21.

In the head 1 according to the present embodiment, as described above, two inlets (the first inlet 20*a*1 and the second inlet 20*a*2) and two outlets (the first outlet 20*b*1 and the second outlet 20*b*2) are provided for each of the individual passages 20 (see FIGS. 2-4). With this configuration, when compared with the case where one inlet and one outlet are formed for each of the individual passages 20, it is difficult for the speed of ink flow to lower at the corner portions of each of the individual passages 20, making it possible to reduce problems in which discharging of the air bubbles and stirring of the settling components are insufficient.

In the case where the supply liquid passages 31*a*, 31*b* and the return liquid passages 32*a*, 32*b* are arranged in a random configuration, the size of the entire liquid passages on the plane extending along the extending direction and the arrangement direction may increase. In the present embodiment, in contrast, the supply liquid passages 31*a*, 31*b* and the return liquid passages 32*a*, 32*b* extend in the same direction (the extending direction) and are arranged in the arrangement direction (see FIG. 2). The individual passages 20 are arranged in the extending direction in each row. This configuration reduces increase in size of the entire liquid passages on the above-described plane.

In the case where the first supply liquid passage 31*a* and the second supply liquid passage 31*b* are located on one side of the individual passages 20 in the arrangement direction, the first supply liquid passage 31*a* and the second supply liquid passage 31*b* need to be formed at positions different from each other in the orthogonal direction, which may increase the size of the head 1 in the orthogonal direction. In the present embodiment, in contrast, the first supply liquid passage 31*a* and the second supply liquid passage 31*b* are located on opposite sides of the individual passages 20 in the arrangement direction (see FIGS. 2 and 4). This configuration reduces the increase in size.

In the case where the first return liquid passage 32*a* and the second return liquid passage 32*b* are located on one side of the individual passages 20 in the arrangement direction, the first return liquid passage 32*a* and the second return liquid passage 32*b* need to be formed at positions different from each other in the orthogonal direction, which may increase the size of the head 1 in the orthogonal direction. In the present embodiment, in contrast, the first return liquid passage 32*a* and the second return liquid passage 32*b* are located on opposite sides of the individual passages 20 in the arrangement direction (see FIGS. 2 and 4). This configuration reduces the increase in size.

The first supply liquid passage 31*a* and the first return liquid passage 32*a* have a portion at which the first supply liquid passage 31*a* and the first return liquid passage 32*a* at least partly overlap each other in the orthogonal direction (see FIGS. 2 and 4). That is, the first supply liquid passage 31*a* and the first return liquid passage 32*a* are arranged so as to partly overlap each other when viewed in the orthogonal direction. This configuration reduces the size of a region for arrangement of the liquid passages in the arrangement direction, resulting in reduction in size of the head 1.

The second supply liquid passage 31*b* and the second return liquid passage 32*b* have a portion at which the second supply liquid passage 31*b* and the second return liquid passage 32*b* at least partly overlap each other in the orthogonal direction (see FIGS. 2 and 4). That is, the second supply liquid passage 31*b* and the second return liquid passage 32*b* are arranged so as to partly overlap each other when viewed in the orthogonal direction. This configuration reduces the size of a region for arrangement of the liquid passages in the arrangement direction, resulting in reduction in size of the head 1.

In the case where the first supply liquid passage 31*a* and the second supply liquid passage 31*b* are located at positions different from each other in the orthogonal direction, the flow of the ink supplied from the first supply liquid passage 31*a* to the individual passage 20 and the flow of the ink supplied from the second supply liquid passage 31*b* to the individual passage 20 are generated at positions different from each other in the orthogonal direction. In the case where the first return liquid passage 32*a* and the second return liquid passage 32*b* are located at positions different from each other in the orthogonal direction, the flow of the ink discharged from the individual passage 20 via the first return liquid passage 32*a* and the flow of the ink discharged from the individual passage 20 via the second return liquid passage 32*b* are generated at positions different from each other in the orthogonal direction. In the present embodiment, in contrast, the first supply liquid passage 31*a* and the second supply liquid passage 31*b* are located at the same position in the orthogonal direction (see FIG. 4). The first return liquid passage 32*a* and the second return liquid passage 32*b* are located at the same position in the orthogonal direction and are located respectively on the one side of the first supply liquid passage 31*a* and the second supply liquid passage 31*b* in the orthogonal direction. Thus, the flow of the ink supplied from the first supply liquid passage 31*a* to the individual passage 20 and the flow of the ink supplied from the second supply liquid passage 31*b* to the individual passage 20 are generated at the same position in the orthogonal direction, and the flow of the ink discharged from the individual passage 20 via the first return liquid passage 32*a* and the flow of the ink discharged from the individual passage 20 via the second return liquid passage 32*b* are generated at the same position in the orthogonal direction. Accordingly, the ink flows easily collide with each other in the individual passages 20, for example, making it possible to more effectively stir the settling components.

The nozzle 21 is located at the one-side end portion of each of the individual passages 20 in the orthogonal direction (see FIG. 4). Since each of the first return liquid passage 32*a* and the second return liquid passage 32*b*, and the nozzle 21 of each of the individual passages 20 are located on the same side (the lower side), it is easy to discharge air bubbles existing near the nozzle 21 from the individual passage 20 via the first return liquid passage 32*a* and the second return liquid passage 32*b*. The first supply liquid passage 31*a* and the second supply liquid passage 31*b* are located on an opposite side from the nozzle 21 of the individual passage 20. With this configuration, the ink supplied from the first supply liquid passage 31*a* and the second supply liquid passage 31*b* to the individual passage 20 smoothly flows toward the nozzle 21, causing ejection of the ink from the nozzle 21 with reduced driving force for the ejection.

The first supply liquid passage 31*a*, the second supply liquid passage 31*b*, the first return liquid passage 32*a*, and the second return liquid passage 32*b* are at least partly defined by the damper films 35*a*, 35*b*, 37*a*, 37*b*, respectively (see FIG. 4). With this configuration, the damper films 35*a*, 35*b*, 37*a*, 37*b* reduce fluid crosstalk between the individual passages 20.

In the case where a damper film provided for the first supply liquid passage 31*a* and the first return liquid passage 32*a* is located between the liquid passages 31*a*, 32*a*, it is difficult to adjust a damping performance for each of the liquid passages 31*a*, 32*a*. Likewise, in the case where a damper film provided for the second supply liquid passage 31*b* and the second return liquid passage 32*b* is located between the liquid passages 31*b*, 32*b*, it is difficult to adjust a damping performance for each of the liquid passages 31*b*, 32*b*. In the present embodiment, in contrast, the damper films 35*a*, 35*b* provided respectively for the first supply liquid passage 31*a* and the second supply liquid passage 31*b* are located on the other side of the first supply liquid passage 31*a* and the second supply liquid passage 31*b* in the orthogonal direction (see FIG. 4). The damper films 37*a*, 37*b* provided respectively for the first return liquid passage 32*a* and the second return liquid passage 32*b* are located on the one side of the first return liquid passage 32*a* and the second return liquid passage 32*b* in the orthogonal direction. In the present embodiment as described above, the damper films are provided for the respective liquid passages 31*a*, 32*a*, 31*b*, 32*b*, making it easy to adjust the damping performance for each of the liquid passages 31*a*, 32*a*, 31*b*, 32*b*. The side surface of each of the liquid passages 31*a*, 32*a*, 31*b*, 32*b* has an opening continuing to a corresponding one of the inlets 20*a*1, 20*a*2 and the outlets 20*b*1, 20*b*2 of the individual passage, making it difficult to provide a damper film. In the present embodiment, however, the damper film is provided on the upper surface or the lower surface of each of the liquid passages 31*a*, 32*a*, 31*b*, 32*b*, making it easy to provide the damper film.

In each of the individual passages 20, the first inflow passage 23*a* and the second inflow passage 23*b* are arranged so as to be symmetric with respect to the center point O of the pressure chamber 22 on the plane extending along the extending direction and the arrangement direction (see FIG. 3). In this configuration, the ink flows collide with each other at the center point O of the pressure chamber 22, making it possible to more effectively stir the settling components in the entire pressure chamber 22.

In each of the individual passages 20, the first outflow passage 24*a* and the second outflow passage 24*b* are arranged so as to be symmetric with respect to the center point O and so as not to overlap the first inflow passage 23*a* and the second inflow passage 23*b* in the orthogonal direction (see FIG. 3). That is, the first outflow passage 24*a* and the second outflow passage 24*b* are arranged so as to be symmetric with respect to the center point O and so as not to overlap the first inflow passage 23*a* and the second inflow passage 23*b* when viewed in the orthogonal direction. With this configuration, the flow of the ink from the center point O toward each of the outlets 20*b*1, 20*b*2 is generated at the center point O of the pressure chamber 22, making it possible to more effectively stir the settling components.

The first outflow passage 24*a* and the second outflow passage 24*b* are located on the one side of the first inflow passage 23*a* and the second inflow passage 23*b* in the orthogonal direction (see FIG. 4). That is, each of the first outflow passage 24*a* and the second outflow passage 24*b*, and the nozzle 21 of each of the individual passages 20 are located on the same side. This configuration makes it easy to discharge air bubbles existing near the nozzle 21, from the individual passage 20 via the first outflow passage 24*a* or the second outflow passage 24*b*.

The first inflow passage 23*a*, the second inflow passage 23*b*, the first outflow passage 24*a*, and the second outflow passage 24*b* are connected to the respective corner portions c1-c4 of the pressure chamber 22 (see FIG. 3). The corner portions c1-c4 of the pressure chamber 22 are regions in which the speed of ink flow easily lowers in particular, and air bubbles easily remain. In the present embodiment, since the inflow passages 23*a*, 23*b* and the outflow passages 24*a*, 24*b* are connected to the respective corner portions c1-c4, the flow of the ink is easily generated at the corner portions c1-c4, making it difficult for the air bubbles to remain.

Second Embodiment

Figure 6:
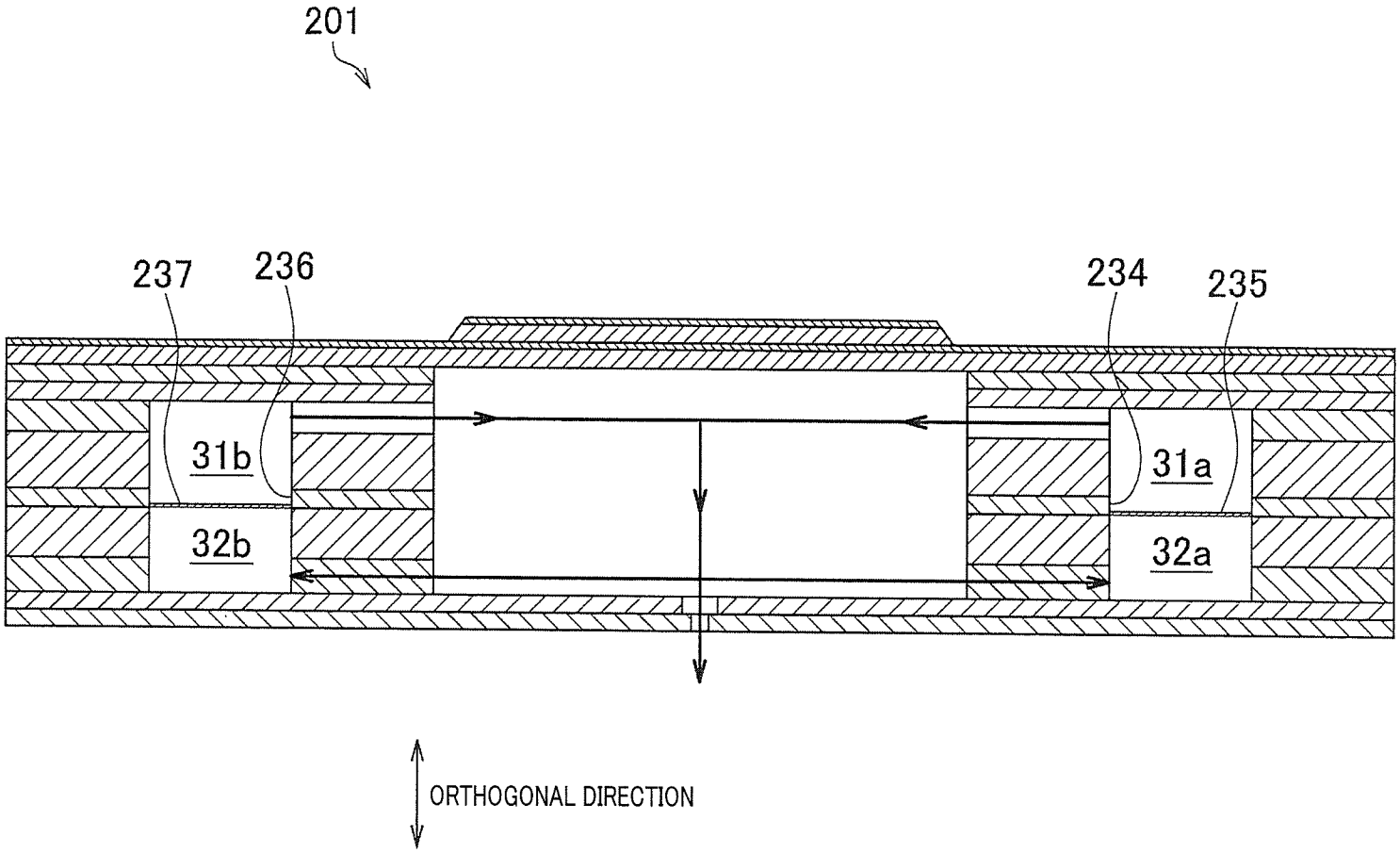
FIG. 6 is a cross-sectional view of a head according to a second embodiment, the view corresponding to FIG. 4.

There will be next described a head 201 according to a second embodiment with reference to FIG. 6. The present embodiment is different from the first embodiment in configuration of damper films provided for the supply liquid passages 31*a*, 31*b* and the return liquid passages 32*a*, 32*b*.

In the first embodiment, the damper films 35*a*, 35*b* are provided on the upper surfaces of the respective supply liquid passages 31*a*, 31*b*, and the damper films 37*a*, 37*b* are provided on the lower surfaces of the respective return liquid passages 32*a*, 32*b* (see FIG. 4).

In the present embodiment, a single damper film 235 contacting the first supply liquid passage 31*a* and the first return liquid passage 32*a* is provided between the first supply liquid passage 31*a* and the first return liquid passage 32*a* in the orthogonal direction. The damper film 235 defines the lower surface of the first supply liquid passage 31*a* and the upper surface of the first return liquid passage 32*a*. A single damper film 237 contacting the second supply liquid passage 31*b* and the second return liquid passage 32*b* is provided between the second supply liquid passage 31*b* and the second return liquid passage 32*b* in the orthogonal direction. The damper film 237 defines the lower surface of the second supply liquid passage 31*b* and the upper surface of the second return liquid passage 32*b*. Specifically, the damper films 235, 237 are provided on the lower surface of the plate 11*e* so as to cover through holes 234, 236 formed in the plate 11*e*.

In the present embodiment, the damper film 235 cancels out pressure waves between the first supply liquid passage 31*a* and the first return liquid passage 32*a*, and the damper film 237 cancels out pressure waves between the second supply liquid passage 31*b* and the second return liquid passage 32*b*.

Third Embodiment

Figure 7:
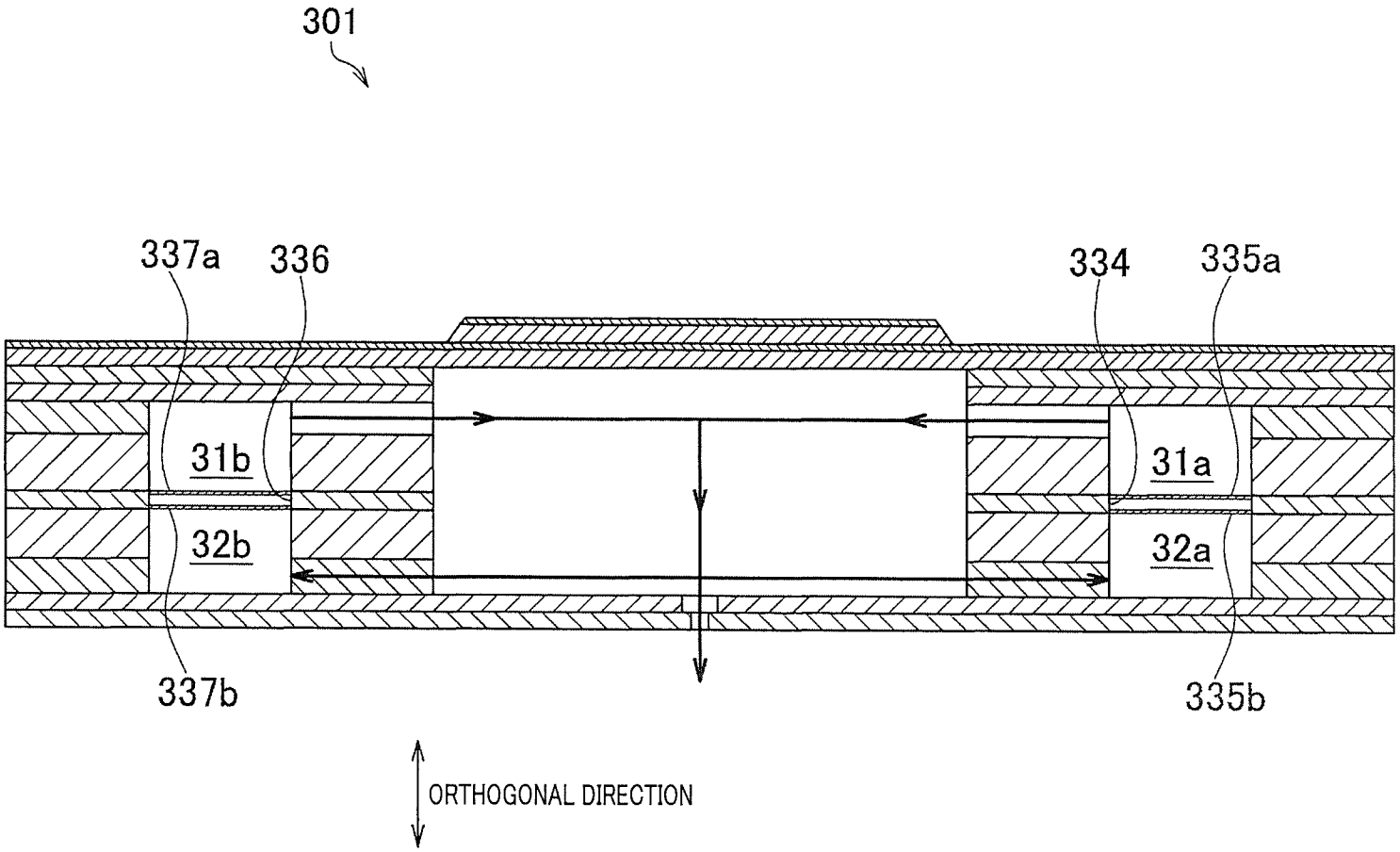
FIG. 7 is a cross-sectional view of a head according to a third embodiment, the view corresponding to FIG. 4.

There will be next described a head 301 according to a third embodiment with reference to FIG. 7. The present embodiment is different from the first embodiment in configuration of damper films provided for the supply liquid passages 31*a*, 31*b* and the return liquid passages 32*a*, 32*b*.

In the first embodiment, the damper films 35*a*, 35*b* are provided on the upper surfaces of the respective supply liquid passages 31*a*, 31*b*, and the damper films 37*a*, 37*b* are provided on the lower surfaces of the respective return liquid passages 32*a*, 32*b* (see FIG. 4).

In the present embodiment, two damper films 335*a*, 335*b* spaced apart from each other in the orthogonal direction are provided between the first supply liquid passage 31*a* and the first return liquid passage 32*a* in the orthogonal direction. Two damper films 337*a*, 337*b* spaced apart from each other in the orthogonal direction are provided between the second supply liquid passage 31*b* and the second return liquid passage 32*b* in the orthogonal direction. The damper films 335*a*, 337*a* are provided on the upper surface of the plate 11*e* so as to respectively cover through holes 334, 336 formed in the plate 11*e*. The damper films 335*b*, 337*b* are provided on the lower surface of the plate 11*e* so as to respectively cover the through holes 334, 336.

In the present embodiment, a space between the damper films 335*a*, 335*b* and a space between the damper films 337*a*, 337*b* achieve the effects of damping the pressure waves.

Fourth Embodiment

Figure 8:
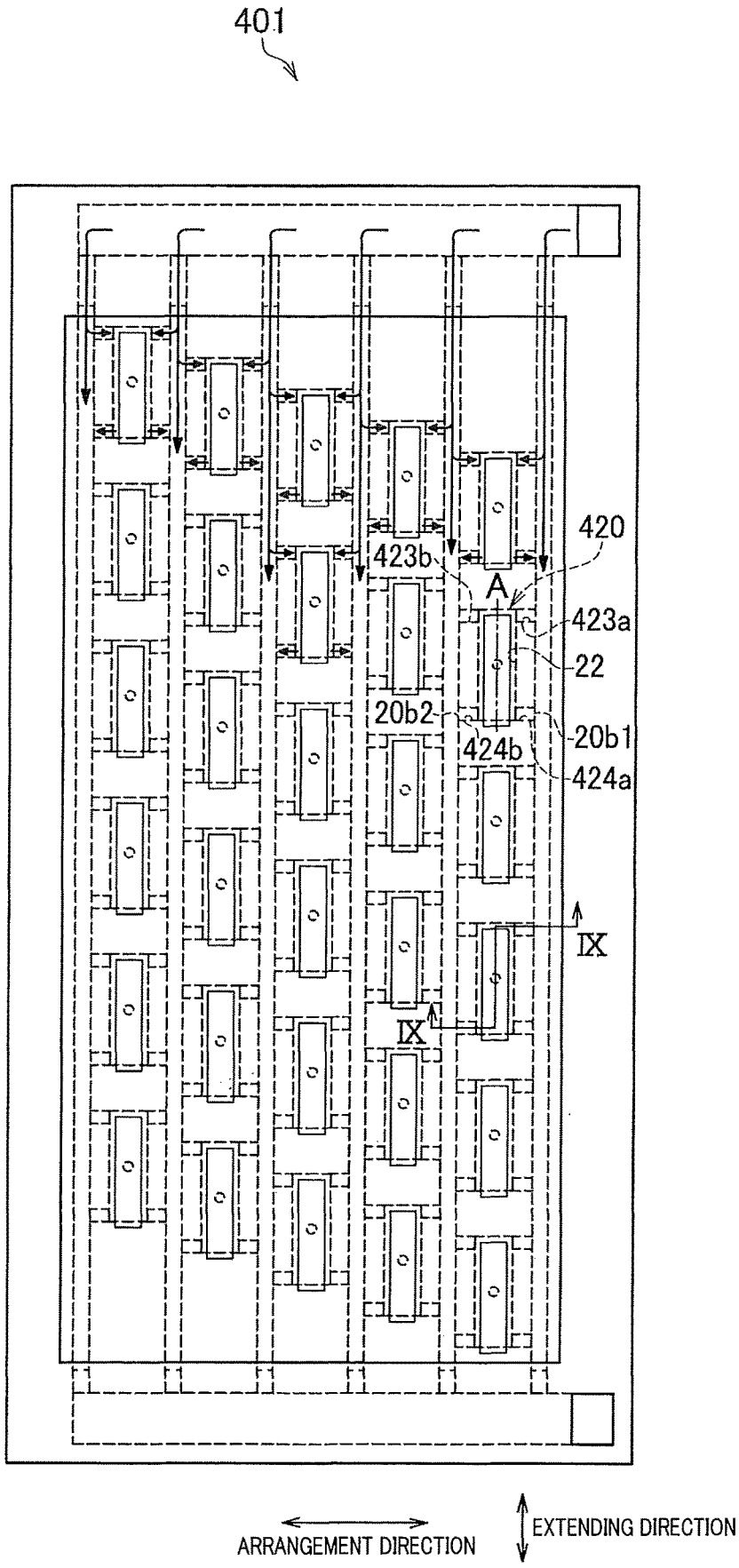
FIG. 8 is a plan view of a head according to a fourth embodiment, the view corresponding to FIG. 4.
Figure 9:
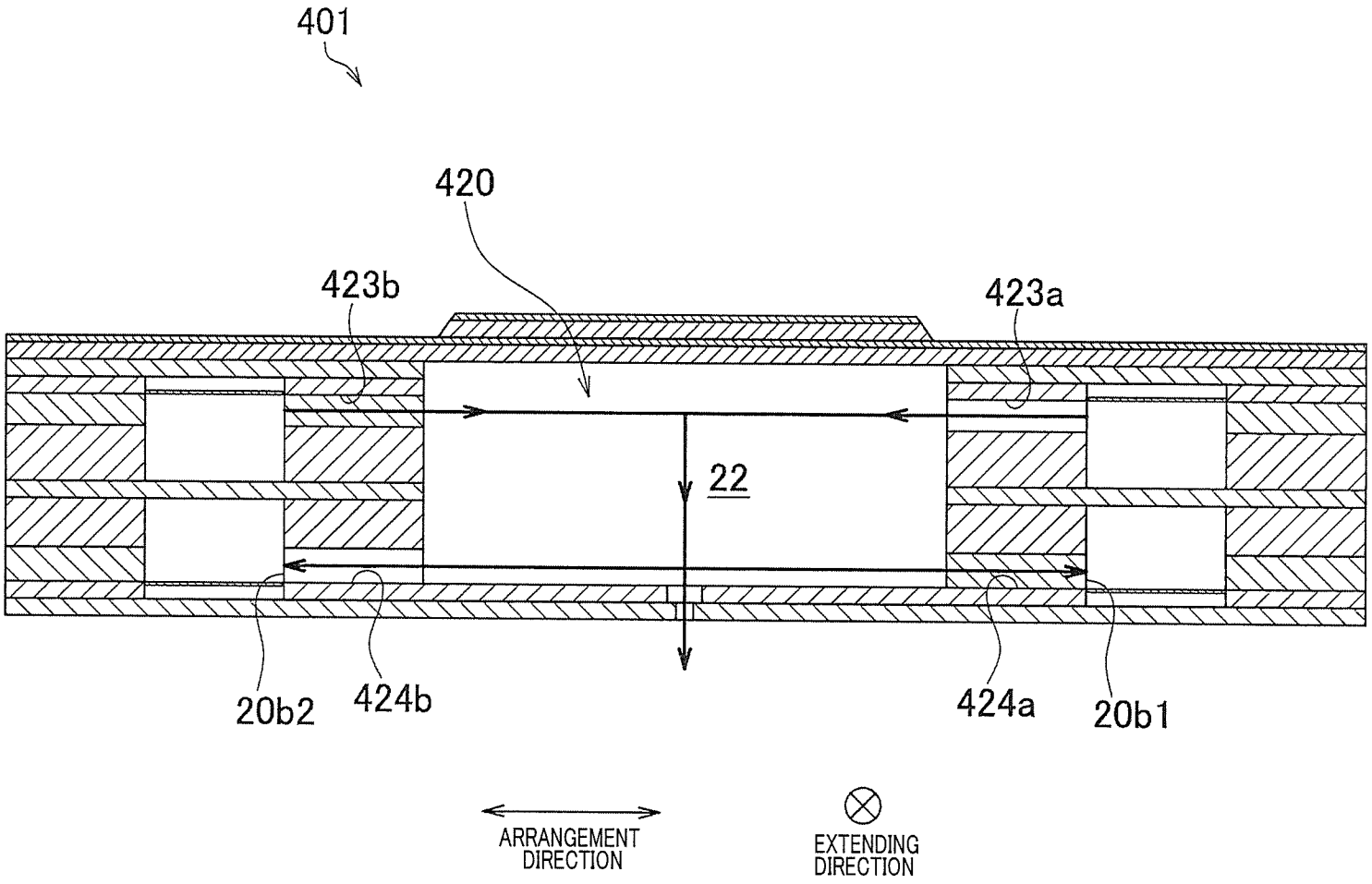
FIG. 9 is a cross-sectional view taken along line IX-IX in FIG. 8.

There will be next described a head 401 according to a fourth embodiment with reference to FIGS. 8 and 9. The present embodiment is different from the first embodiment in configuration of the inflow passages and the outflow passages of each of the individual passages.

In the first embodiment, in each of the individual passages 20, the first inflow passage 23*a* and the second inflow passage 23*b* are arranged so as to be symmetric with respect to the center point O of the pressure chamber 22, and the first outflow passage 24*a* and the second outflow passage 24*b* are arranged so as to be symmetric with respect to the center point O of the pressure chamber 22 on the plane extending along the extending direction and the arrangement direction (see FIG. 3).

In the present embodiment, in each of individual passages 420, a first inflow passage 423*a* and a second inflow passage 423*b* are arranged so as to be symmetric with respect to the axis A extending along the extending direction through the center of the pressure chamber 22 in the arrangement direction, and a first outflow passage 424*a* and a second outflow passage 424*b* are arranged so as to be symmetric with respect to the axis A.

In the present embodiment, the first inflow passage 423*a* and the second inflow passage 423*b* are arranged so as to be symmetric with respect to the axis A. The ink flows collide with each other at a portion of the pressure chamber 22 which is located on the axis A (i.e., a portion of the pressure chamber 22 at which the first inflow passage 423*a* and the second inflow passage 423*b* are opposed to each other in the arrangement direction), making it possible to more effectively stir the settling components in the entire pressure chamber 22.

The first outflow passage 424*a* and the second outflow passage 424*b* are arranged so as to be symmetric with respect to the axis A. The ink flows collide with each other at a portion of the pressure chamber 22 which is located on the axis A (i.e., a portion of the pressure chamber 22 at which the first inflow passage 423*a* and the second inflow passage 423*b* are opposed to each other in the arrangement direction), making it possible to more effectively stir the settling components in the entire pressure chamber 22. The flow of the ink from the portion of the pressure chamber 22 which is located on the axis A (i.e., a portion of the pressure chamber 22 at which the first outflow passage 424*a* and the second outflow passage 424*b* are opposed to each other in the arrangement direction), toward each of the outlets 20*b*1, 20*b*2 is generated at the portion of the pressure chamber 22 which is located on the axis A, making it possible to much more effectively stir the settling components.

Fifth Embodiment

Figure 10:
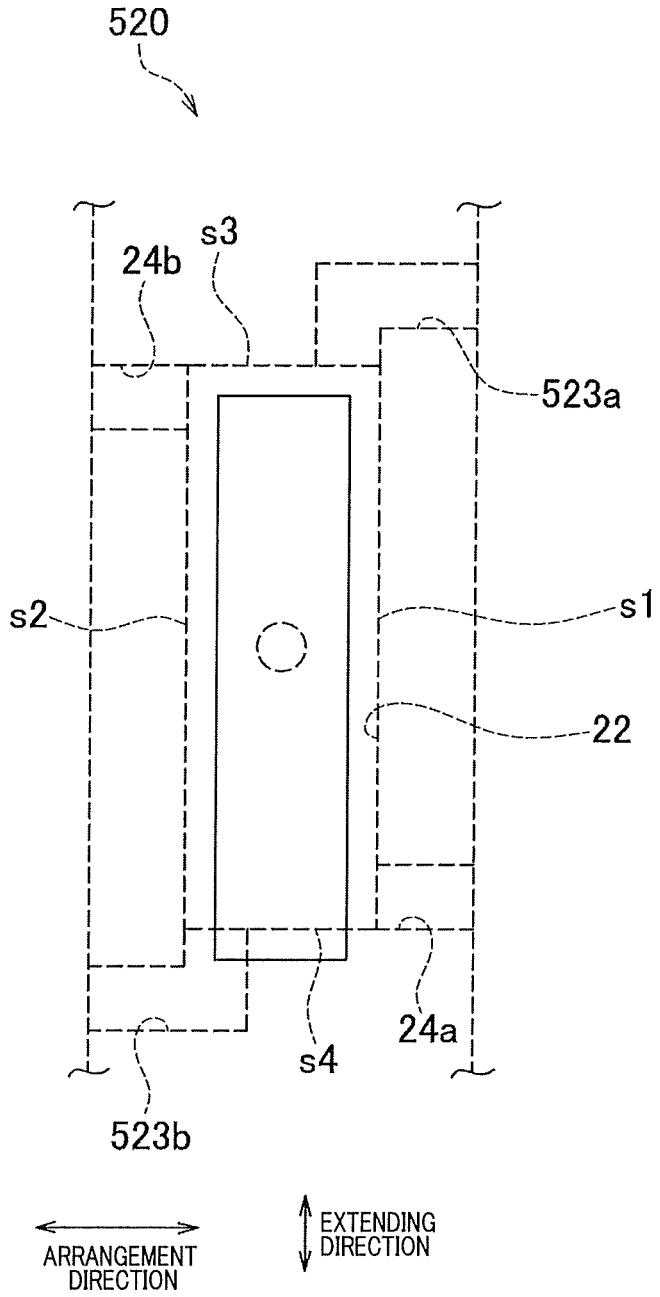
FIG. 10 is an enlarged view of a head according to a fifth embodiment, the view corresponding to FIG. 3.

There will be next described a head according to a fifth embodiment with reference to FIG. 10. The present embodiment is different from the first embodiment in configuration of the inflow passages of each of the individual passages.

In the first embodiment, in each of the individual passages 20, the first inflow passage 23*a* and the second inflow passage 23*b* are connected to the respective sides s1, s2 of the pressure chamber 22 which extend in the extending direction (see FIG. 3). The first inflow passage 23*a* and the first outflow passage 24*a* are connected to the side s1, and the second inflow passage 23*b* and the second outflow passage 24*b* are connected to the side s2. No inflow passages and outflow passages are connected to the sides s3, s4 extending in the arrangement direction.

In the present embodiment, in each of individual passages 520, a first inflow passage 523*a* and a second inflow passage 523*b* are connected to the respective sides s3, s4 of the pressure chamber 22 which extend in the arrangement direction. Each of the first inflow passage 523*a* and the second inflow passage 523*b* is bent or curved on the plane extending along the extending direction and the arrangement direction. The first outflow passage 24*a* is connected to the side s1, the second outflow passage 24*b* to the side s2, the first inflow passage 523*a* to the side s3, and the second inflow passage 523*b* to the side s4.

In the present embodiment, the first outflow passage 24*a*, the second outflow passage 24*b*, the first inflow passage 523*a*, and the second inflow passage 523*b* are connected respectively to the different sides s1-s4 of the pressure chamber 22. Thus, the ink flows in various directions in the pressure chamber 22, making it possible to much more effectively stir the settling components.

Modifications

While the embodiments have been described above, it is to be understood that the disclosure is not limited to the details of the illustrated embodiments, but may be embodied with various changes and modifications, which may occur to those skilled in the art, without departing from the spirit and scope of the disclosure.

While two inlets and two outlets formed in each of the individual passages in the above-described embodiments, three or more inlets and/or three or more outlets may be formed. In this case, three or more supply liquid passages and/or three or more return liquid passages may be connected to each of the individual passages.

While a plurality of the first supply liquid passages, a plurality of the second supply liquid passages, a plurality of the first return liquid passages, and a plurality of the second return liquid passages are formed in the above-described embodiments, the single first supply liquid passage, the single second supply liquid passage, the single first return liquid passage, and single the second return liquid passage may be formed.

The first supply liquid passages, the second supply liquid passages, the first return liquid passages, and the second return liquid passages extend in the same direction in the above-described embodiments and may extend in different directions.

In the above-described embodiment (FIGS. 2 and 4), the first supply liquid passage 31*a* and the first return liquid passage 32*a* coincide with each other in the orthogonal direction substantially entirely on the plane orthogonal to the orthogonal direction, but the present disclosure is not limited to this configuration. That is, the first supply liquid passage and the first return liquid passage only have to at least partly overlap each other in the orthogonal direction. Thus, the first supply liquid passage and the first return liquid passage may be slightly different from each other in position in the extending direction, for example. Likewise, in the above-described embodiment (FIGS. 2 and 4), the second supply liquid passage 31*b* and the second return liquid passage 32*b* coincide with each other in the orthogonal direction substantially entirely on the plane orthogonal to the orthogonal direction, but the present disclosure is not limited to this configuration. That is, the second supply liquid passage and the second return liquid passage only have to at least partly overlap each other in the orthogonal direction. Thus, the second supply liquid passage and the second return liquid passage may be slightly different from each other in position in the extending direction, for example.

The first supply liquid passage and the second supply liquid passage may be located on one side of the individual passages in the arrangement direction. Likewise, the first return liquid passage and the second return liquid passage may be located on one side of the individual passages in the arrangement direction.

The positions of the supply coupling liquid passage and the return coupling liquid passage are not limited in particular. For example, the supply coupling liquid passage and the return coupling liquid passage may be located on one side of the first supply liquid passages, the second supply liquid passages, the first return liquid passages, and the second return liquid passages in the extending direction and may overlap each other in the orthogonal direction. It is noted that the first supply liquid passages and the second supply liquid passages may not be coupled to each other by the supply coupling liquid passage and may be connected to the storage chamber individually. Likewise, the first return liquid passage and the second return liquid passage may not be coupled to each other by the return coupling liquid passage and may be connected to the storage chamber individually.

In each of the first supply liquid passages, the second supply liquid passages, the first return liquid passages, and the second return liquid passages, a damper film may be provided on a side surface of the liquid passage which has an opening continuing to the inlet or the outlet of the individual passage. No damper film may be provided for each of the first supply liquid passages, the second supply liquid passages, the first return liquid passages, and the second return liquid passages.

The positional relationship among the first supply liquid passages, the second supply liquid passages, the first return liquid passages, and the second return liquid passages in the orthogonal direction is not limited in particular. For example, the first supply liquid passage and the second supply liquid passage may be located at different positions in the orthogonal direction. The first return liquid passage and the second return liquid passage may be located at different positions in the orthogonal direction. The first supply liquid passage and the second supply liquid passage may be located below the first return liquid passage and the second return liquid passage. In other words, the first supply liquid passage and the second supply liquid passage may be located on the one side of the first return liquid passage and the second return liquid passage in the orthogonal direction.

In the above-described embodiment (FIG. 2), the pair of the first supply liquid passage 31*a* and the first return liquid passage 32*a* or the pair of the second supply liquid passage 31*b* and the second return liquid passage 32*b* formed between two of the rows of the individual passages 20 which are adjacent to each other in the arrangement direction communicate with the individual passages 20 belonging to the two rows. However, the present disclosure is not limited to this configuration. For example, the pair of the first supply liquid passage 31*a* and the first return liquid passage 32*a* and the pair of the second supply liquid passage 31*b* and the second return liquid passage 32*b* may be formed for each row of the individual passages 20.

The individual passages need not be arranged in rows and may be arranged on a random basis.

The configuration of each of the individual passages (e.g., the shape of the pressure chamber and a manner of communication between the pressure chamber and the nozzle) is not limited in particular. For example, the pressure chamber may have any shape on the plane extending along the extending direction and the arrangement direction, such as a square, a parallelogram, a rhombus, a perfect circle, and an oval. While the pressure chamber is formed just above the nozzle in the above-described embodiments, the present disclosure is not limited to this configuration. For example, another liquid passage establishing communication between the pressure chamber and the nozzle may be formed. Each of the number of the nozzles and the number of the pressure chambers in each of the individual passages is not limited to one and may be two or more.

The positions of the first inflow passage, the second inflow passage, the first outflow passage, and the second outflow passage are not limited in particular. For example, the head may be configured such that the first outflow passage 24*a* and the second outflow passage 24*b* do not overlap the first inflow passage 23*a* and the second inflow passage 23*b* in the orthogonal direction in the above-described embodiment (FIG. 3) but may overlap the first inflow passage 23*a* and the second inflow passage 23*b* in the orthogonal direction, respectively. The head may be configured such that the first inflow passage 23*a* and the first outflow passage 24*a* overlapping each other in the orthogonal direction are connected to the center of the side s1 in the extending direction, and the second inflow passage 23*b* and the second outflow passage 24*b* overlapping each other in the orthogonal direction are connected to the center of the side s2 in the extending direction. That is, each of the first inflow passage, the second inflow passage, the first outflow passage, and the second outflow passage need not be connected to a corresponding one of the corner portions of the pressure chamber. The first inflow passage, the second inflow passage, the first outflow passage, and the second outflow passage may be located at the same position in the orthogonal direction. The first inflow passage and the second inflow passage may be located below the first outflow passage and the second outflow passage, in other words, the first inflow passage and the second inflow passage may be located on the one side of the first outflow passage and the second outflow passage in the orthogonal direction.

The actuator is not limited to the piezoelectric actuator using piezoelectric elements and may be of any other type such as a thermal actuator using heating elements and an electrostatic actuator using an electrostatic force.

The head is not limited to the line head and may be a serial head which ejects liquid from nozzles onto a recording medium while moving in a scanning direction parallel with the widthwise direction of the sheet.

The recording medium is not limited to the sheet and may be any of a cloth, a circuit board, and the like.

The liquid ejected from the nozzles is not limited to the ink and may be any other type of liquid such as treatment liquid that coagulates or precipitates components of the ink.

The present disclosure is applied to the printer in the above-described embodiments but may be applied to a facsimile, a copying machine, and a multi-function peripheral (MFP), for example. The present disclosure may also be applied to a liquid ejection apparatus used for purposes different from image recording. For example, the present disclosure may be applied to a liquid ejection apparatus configured to eject conductive liquid onto a substrate to form a conductive pattern on the substrate.

What is claimed is:

1. A liquid ejection head, comprising:

a plurality of individual passages each comprising a nozzle;

a first supply liquid passage communicating with a first inlet of each of the plurality of individual passages;

a second supply liquid passage communicating with a second inlet of each of the plurality of individual passages;

a first return liquid passage communicating with a first outlet of each of the plurality of individual passages; and a second return liquid passage communicating with a second outlet of each of the plurality of individual passages.

2. The liquid ejection head according to claim 1, wherein the first supply liquid passage, the second supply liquid passage, the first return liquid passage, and the second return liquid passage extend in an extending direction and are arranged in an arrangement direction intersecting the extending direction, and wherein the plurality of individual passages are arranged in the extending direction.

3. The liquid ejection head according to claim 2, wherein the first supply liquid passage and the second supply liquid passage are located respectively on opposite sides of the plurality of individual passages in the arrangement direction.

4. The liquid ejection head according to claim 3, wherein the first supply liquid passage and the first return liquid passage are arranged so as to at least partly overlap each other when viewed in an orthogonal direction orthogonal to each of the extending direction and the arrangement direction.

5. The liquid ejection head according to claim 4, wherein the second supply liquid passage and the second return liquid passage are arranged so as to at least partly overlap each other when viewed in the orthogonal direction.

6. The liquid ejection head according to claim 5, wherein the first supply liquid passage and the second supply liquid passage are located at an identical position in the orthogonal direction, and wherein the first return liquid passage and the second return liquid passage are located at an identical position in the orthogonal direction and located on one side of the first supply liquid passage and the second supply liquid passage in the orthogonal direction.

7. The liquid ejection head according to claim 6, wherein the nozzle is located at one of opposite end portions of each of the plurality of individual passages in the orthogonal direction, which one is located on the one side of the other of the opposite end portions in the orthogonal direction.

8. The liquid ejection head according to claim 6, wherein at least a portion of each of the first supply liquid passage, the second supply liquid passage, the first return liquid passage, and the second return liquid passage is defined by a damper film.

9. The liquid ejection head according to claim 8, wherein the damper film provided for each of the first supply liquid passage and the second supply liquid passage is located on the other side of the first supply liquid passage and the second supply liquid passage in the orthogonal direction, and wherein the damper film provided for each of the first return liquid passage and the second return liquid passage is located on the one side of the first return liquid passage and the second return liquid passage in the orthogonal direction.

10. The liquid ejection head according to claim 8, wherein a single damper film as the damper film which contacts the first supply liquid passage and the first return liquid passage is provided between the first supply liquid passage and the first return liquid passage in the orthogonal direction, and wherein a single damper film as the damper film which contacts the second supply liquid passage and the second return liquid passage is provided between the second supply liquid passage and the second return liquid passage in the orthogonal direction.

11. The liquid ejection head according to claim 8, wherein two damper films each as the damper film which are spaced apart from each other in the orthogonal direction are provided between the first supply liquid passage and the first return liquid passage in the orthogonal direction, and wherein two damper films each as the damper film which are spaced apart from each other in the orthogonal direction are provided between the second supply liquid passage and the second return liquid passage in the orthogonal direction.

12. The liquid ejection head according to claim 2, wherein the first return liquid passage and the second return liquid passage are located respectively on opposite sides of the plurality of individual passages in the arrangement direction.

13. The liquid ejection head according to claim 3, wherein each of the plurality of individual passages comprises:

a pressure chamber communicating with the nozzle;

a first inflow passage connecting the pressure chamber and the first inlet to each other; and a second inflow passage connecting the pressure chamber and the second inlet to each other, and wherein, in each of the plurality of individual passages, the first inflow passage and the second inflow passage are arranged so as to be symmetric with respect to a center point of the pressure chamber on a plane extending along the extending direction and the arrangement direction when viewed in an orthogonal direction orthogonal to each of the extending direction and the arrangement direction.

14. The liquid ejection head according to claim 13, wherein each of the plurality of individual passages comprises:

a pressure chamber communicating with the nozzle;

a first outflow passage connecting the pressure chamber and the first outlet to each other; and a second outflow passage connecting the pressure chamber and the second outlet to each other, and wherein, in each of the plurality of individual passages, the first outflow passage and the second outflow passage are arranged so as to be symmetric with respect to a center point of the pressure chamber on a plane extending along the extending direction and the arrangement direction when viewed in the orthogonal direction and are arranged so as not to overlap the first inflow passage and the second inflow passage when viewed in the orthogonal direction.

15. The liquid ejection head according to claim 3, wherein each of the plurality of individual passages comprises:

a pressure chamber communicating with the nozzle;

a first inflow passage connecting the pressure chamber and the first inlet to each other; and a second inflow passage connecting the pressure chamber and the second inlet to each other, and wherein, in each of the plurality of individual passages, the first inflow passage and the second inflow passage are arranged so as to be symmetric with respect to an axis extending along the extending direction through a center of the pressure chamber in the arrangement direction when viewed in an orthogonal direction orthogonal to each of the extending direction and the arrangement direction.

16. The liquid ejection head according to claim 3, wherein each of the plurality of individual passages comprises:

a pressure chamber communicating with the nozzle;

a first outflow passage connecting the pressure chamber and the first outlet to each other; and a second outflow passage connecting the pressure chamber and the second outlet to each other, and wherein, in each of the plurality of individual passages, the first outflow passage and the second outflow passage are arranged so as to be symmetric with respect to an axis extending along the extending direction through a center of the pressure chamber in the arrangement direction when viewed in an orthogonal direction orthogonal to each of the extending direction and the arrangement direction.

17. The liquid ejection head according to claim 2, wherein each of the plurality of individual passages comprises:

a pressure chamber communicating with the nozzle;

a first inflow passage connecting the pressure chamber and the first inlet to each other;

a second inflow passage connecting the pressure chamber and the second inlet to each other;

a first outflow passage connecting the pressure chamber and the first outlet to each other; and a second outflow passage connecting the pressure chamber and the second outlet to each other, and wherein, in each of the plurality of individual passages, the nozzle is located on one side of the pressure chamber in an orthogonal direction orthogonal to each of the extending direction and the arrangement direction, and the first outflow passage and the second outflow passage are located on the one side of the first inflow passage and the second inflow passage in the orthogonal direction.

18. The liquid ejection head according to claim 2, wherein each of the plurality of individual passages comprises:

a pressure chamber communicating with the nozzle;

a first inflow passage connecting the pressure chamber and the first inlet to each other;

a second inflow passage connecting the pressure chamber and the second inlet to each other;

a first outflow passage connecting the pressure chamber and the first outlet to each other; and a second outflow passage connecting the pressure chamber and the second outlet to each other, and wherein, in each of the plurality of individual passages, the pressure chamber comprises at least four corner portions on a plane extending along the extending direction and the arrangement direction, and the first inflow passage, the second inflow passage, the first outflow passage, and the second outflow passage are respectively connected to four of the at least four corner portions which are different from each other.

19. The liquid ejection head according to claim 2, wherein each of the plurality of individual passages comprises:

a pressure chamber communicating with the nozzle;

a first inflow passage connecting the pressure chamber and the first inlet to each other;

a second inflow passage connecting the pressure chamber and the second inlet to each other;

a first outflow passage connecting the pressure chamber and the first outlet to each other; and a second outflow passage connecting the pressure chamber and the second outlet to each other, and wherein, in each of the plurality of individual passages, the pressure chamber comprises at least four sides on a plane extending along the extending direction and the arrangement direction, and the first inflow passage, the second inflow passage, the first outflow passage, and the second outflow passage are respectively connected to four of the at least four sides which are different from each other.

* * * * *